US008347802B2

(12) United States Patent
Pereira

(10) Patent No.: US 8,347,802 B2
(45) **Date of Patent: *Jan. 8, 2013**

(54) WATERCRAFT WITH REACTIVE SUSPENSION AND AN INTEGRATED BRAKING AND STEERING SYSTEM

(76) Inventor: Fred Pereira, Las Vegas, NV (US)

( * ) Notice: Subject to any disclaimer, the term of this patent is extended or adjusted under 35 U.S.C. 154(b) by 303 days.

This patent is subject to a terminal disclaimer.

(21) Appl. No.: 12/592,885

(22) Filed: Dec. 3, 2009

(65) Prior Publication Data

US 2010/0132603 A1 Jun. 3, 2010

Related U.S. Application Data

(60) Provisional application No. 61/200,682, filed on Dec. 3, 2008.

(51) Int. Cl.
*B63B 35/73* (2006.01)

(52) U.S. Cl. ..... 114/55.54

(58) Field of Classification Search ..... 114/55.5, 114/55.54, 55.55, 55.56, 55.57, 55.58, 271, 114/278, 279, 280, 281, 282, 283, 284
See application file for complete search history.

(56) References Cited

U.S. PATENT DOCUMENTS

| | | | | | |
|---|---|---|---|---|---|
| 3,158,129 | A * | 11/1964 | Mauer | 114/55.55 |
| 3,280,786 | A * | 10/1966 | Rowell | 440/38 |
| 3,483,844 | A * | 12/1969 | Trautwein | 114/55.55 |
| 3,517,632 | A * | 6/1970 | Gray | 114/283 |
| 3,922,994 | A * | 12/1975 | De Long | 114/281 |
| 3,948,206 | A * | 4/1976 | Tyler | 114/55.51 |
| 4,014,283 | A * | 3/1977 | Crnogorac | 114/55.55 |
| 4,351,262 | A * | 9/1982 | Matthews | 114/284 |
| 5,520,133 | A * | 5/1996 | Wiegert | 114/125 |
| 5,697,317 | A * | 12/1997 | Pereira | 114/55.52 |
| 6,620,003 | B2 * | 9/2003 | Mardikian | 440/38 |

* cited by examiner

*Primary Examiner* — Daniel Venne
(74) *Attorney, Agent, or Firm* — Mark S. Hubert

(57) ABSTRACT

A watercraft with several stability and handling design improvements. It has an enhanced reactive suspension system positioned in the vessel between a set of separating hull and body components. The watercraft also has improved braking, steering and stabilizing systems designed around multiple pivoting mechanisms on the vessel hull that work individually or in unison to achieve the desired braking or steering effect. The stabilizing system is operated by a computerized, gyroscopic hydraulic control to maintain stability and comfort of ride, minimizing the roll, pitch and yaw commonly experienced in the passenger compartment.

11 Claims, 6 Drawing Sheets

100
4
6
11
60
10
2

WATERCRAFT WITH REACTIVE SUSPENSION AND AN INTEGRATED BRAKING AND STEERING SYSTEM

Applicant claims priority of U.S. Provisional Patent Application Ser. No. 61/200,682 entitled "Watercraft Stabilization System", filed Dec. 3, 2008, and incorporates by reference all material therein.

BACKGROUND OF THE INVENTION

The present invention relates to a watercraft with an improved suspension system adapted to ensure that a smooth ride is experienced on the passenger seat. More particularly, to a water vessel designed to provide, stability, comfort as well as enhanced performance and safety.

Heretofore, because of the inherent jostling of a water vessel motorized watersports such as boating have been for those who are not prone to motion sickness or have back disorders. This new invention utilizes and combines known and new technologies in a unique and novel configuration to overcome the aforementioned "jostling" problems and accomplish this. Furthermore this new invention allows a level of control over the steering and braking of a watercraft that has not heretofore been experienced, opening up an entire new level of trick maneuvers for the experienced rider.

SUMMARY OF THE INVENTION

The general purpose of the present invention, which will be described subsequently in greater detail, is to provide a watercraft configured similar to a motorcycle (waterbike) with an enhanced suspension system that is able to stabilize the passenger seat with respect to the motion of the hull assembly and provide a level of comfort and minimized motion heretofore unknown in the water sport industry. This waterbike has many of the advantages mentioned heretofore and many novel features that result in a new waterbike which is not anticipated, rendered obvious, suggested, or even implied by any of the prior art, either alone or in any combination thereof.

An object of the present invention is to provide an improved waterbike suspension system that connects and resides between the vessel hull and vessel body and is capable of dramatically reducing the roll, pitch and yaw experienced by the passenger.

It is another object of this invention to provide a waterbike with an improved steering and braking system capable of meeting or exceeding all known standards for waterbike handling.

It is a further object of this invention to provide a waterbike adapted for use by persons prone to discomfort or injury as a result of excessive roll, pitch or yaw motions imparted to their bodies.

It is yet a further object of this invention to provide a waterbike with enhanced handling characteristics.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DRAWINGS

DETAILED DESCRIPTION

Figure 1:
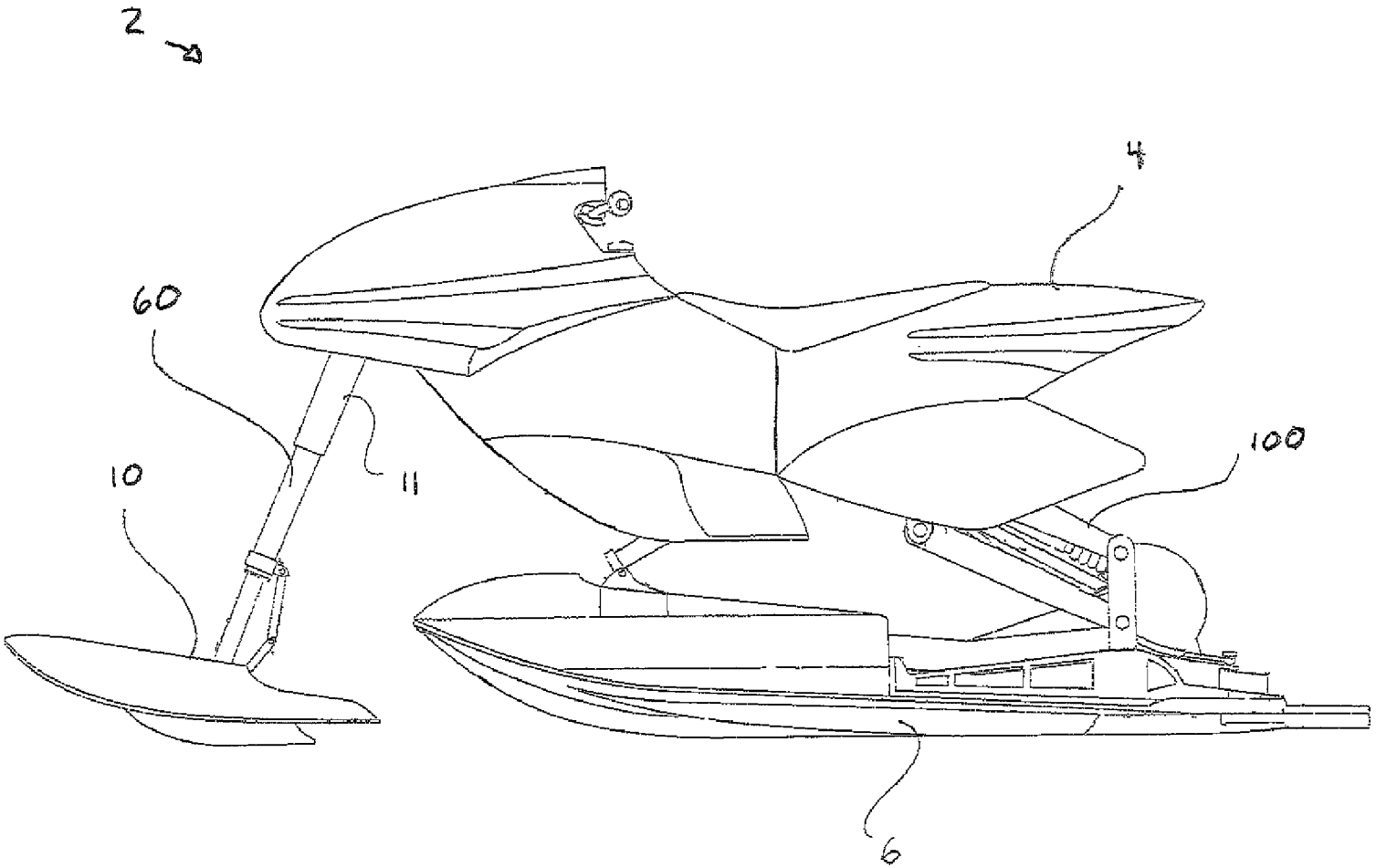
FIG. 1 is a side view of the improved waterbike in an elevated configuration.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Looking at FIG. 1 it can be seen that the present invention entails a watercraft configured and stylized similar to a motorcycle hereinafter referred to as a waterbike 2 that is made of a body section 4 that is operatively connected to a propulsion/lower hull section 6 by an extendible suspension system, and a front ski assembly 10 operatively connected to the body section 4 by an extendible front shock absorber means 11. Looking at FIG. 2 is can be seen that the extendible suspension system has a central lift shock tube (shock absorber) 12 that may be extended upward pneumatically (or optionally hydraulically) so as to upwardly increase the separation distance between the body section 4 and the lower hull section 6.

Figure 2:
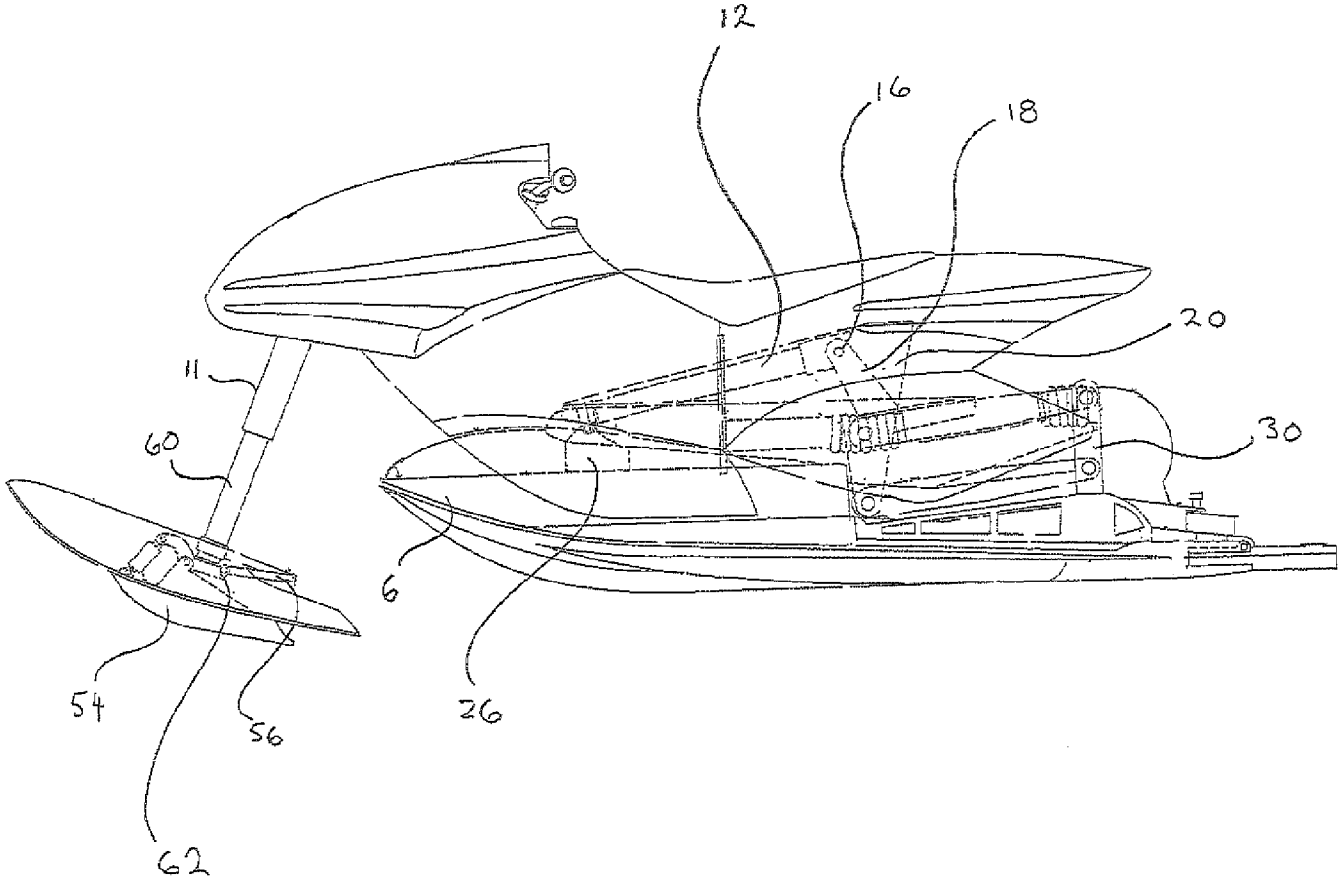
FIG. 2 is a side view of the improved waterbike in a contracted configuration showing a phantom representation of the suspension system.
Figure 4:
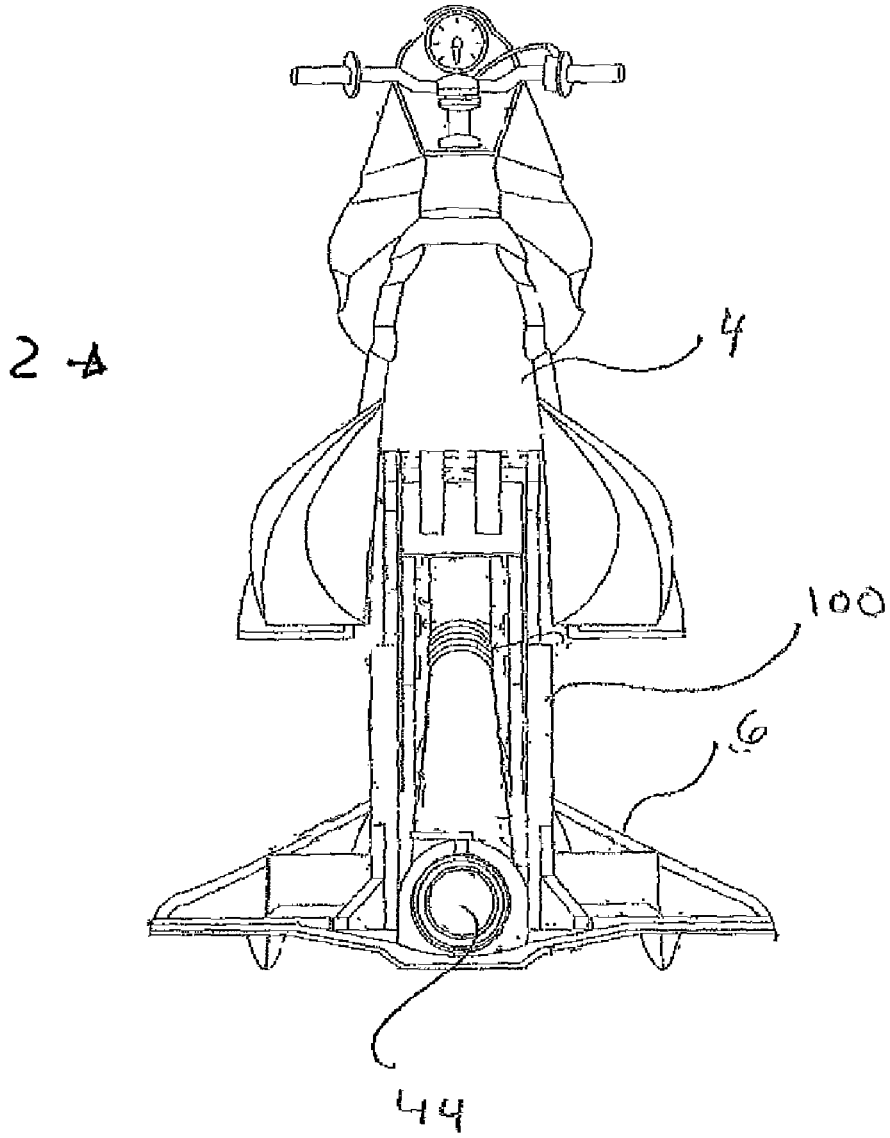
FIG. 4 is a rear view of the improved waterbike in an elevated configuration.

Comparing FIG. 1 and FIG. 2, the elevated ride height of the waterbike 2 can bee seen. Here the front shock absorber means 11 and the central lift shock tube 12 can both be seen pumped full of air so as to increase their effective length and raise the body section 4 vertically above the lower hull section 6. FIG. 4 also shows the waterbike 2 in the elevated configuration.

Figure 3:
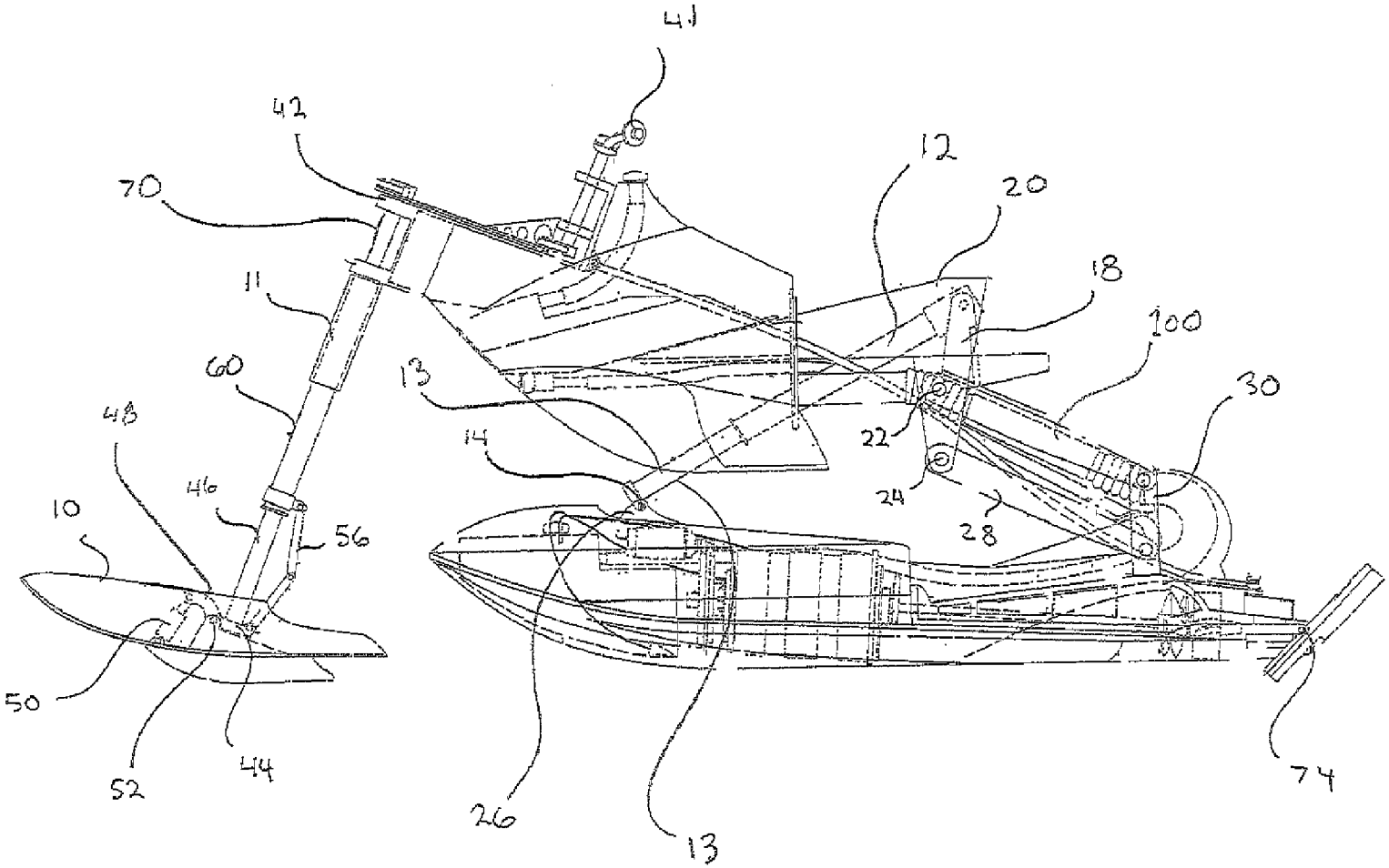
FIG. 3 is a side view of the improved waterbike in an elevated configuration showing a phantom representation of the suspension system.

Looking at FIGS. 2 and 3, phantom representations of the waterbike's suspension system in the contracted configuration and in the elevated configuration, it can be seen that body section 4 may be extended or raised above the lower hull section 6. This extension is done pneumatically by the addition of pressurized gas into central lift shock tube 12 by a pneumatic control unit. Such pneumatic control units are generally comprised of a compressor, a tank, a pressure gauge, and an actuator and have been well known in the industry for years and the details of their operation and the specific configuration and selection of their integral components do not comprise part of the present invention. For visual clarity the pneumatic control unit has been eliminated from the figures.

The central lift shock tube 12 is comprised of a front end tube 13 and a rear end tube 13 slidingly engaged for extension upon the admission of a pressurized gas (or fluid.) The admission of air into the central lift shock tube 12 is done via manual control. The central lift shock tube 12 has its front end 13 pivotally connected by a first axle to a lower subframe 26 which is a linear U shaped tubular member securely mounted to the lower hull section 6 such that the longitudinal axis of the lower subframe 26 resides parallel to the longitudinal axis of the waterbike 2. The rear end of the central lift shock tube 12 is pivotally connected to a pivot linkage system. This pivot linkage system pivotally connects the rear end of the shock tube 12 by a second axle 16 to a pair of parallel pivot swingarms 18. This admission of pressurized gas causes the extension of the rear end of the shock tube 12 so as to push on the top end of the pair of pivot swingarms 18 so as to tilt the swingarms 18 rearward and upward. Each of the pivot swingarms 18 are pivotally connected to an upper subframe 20 by a third axle 22 and a fourth axle 24. The upper subframe is rigidly connected to the body 4. At these same pivot connections (axles 23 and 24) on each of the pivot swingarms 18 there are also pivotal connections to the first end of a pair of upper lift arms 100 and the first end of a parallel and substantially similar pair of lower lift arms 28. The second ends of these pairs of upper and lower lift arms are pivotally connected to a pair of rear stanchions 30 each rigidly mounted to the rear of the lower hull section 6.

Figure 5:
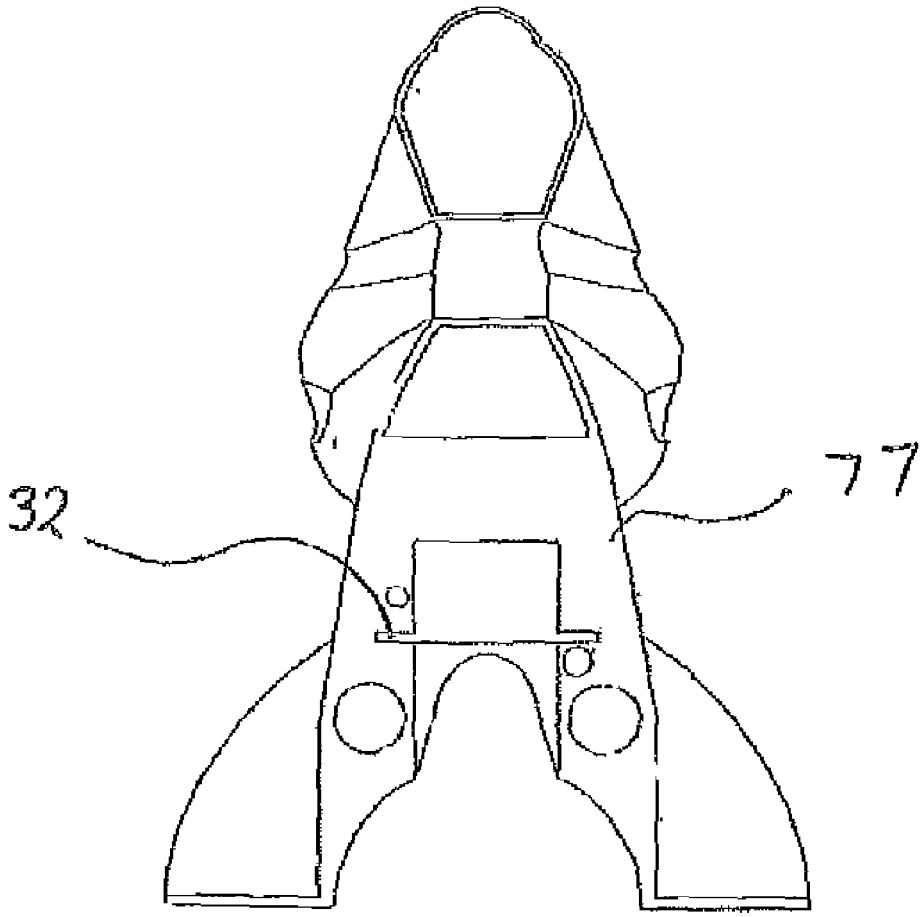
FIG. 5 is a rear view of the upper hull shell.

The upper subframe 20 is connected to the body section 4 by means of sliding subframe 20 into channel grooves 32 (as shown in FIG. 5) In this way, while the upper subframe 20 resides about the central lift shock tube 12 when the waterbike 2 is in the contracted position (as shown in FIG. 2) when the waterbike is in the elevated position (as shown in FIG. 3) the body section 4 may rise parallel to the hull section 6 with the additional lift of the front shock absorber means 11. It is to be noted because of the rearward tilting action of the pivot swingarms 18, when moving into the elevated configuration the body 4 moves slightly aft of the hull 6.

The pivotal connections on the front end of the central lift shock tube 13, the lower subframe 26, the rear end of the central lift shock tube 12, the upper lift arms 100, the lower lift arms 28, the subframe 20, the pivot swingarms 18 and the rear stanchions 30 are accommodated by linear axles that tie the pivotal connections together between the two parallel sides or alternatively by short pivot shafts.

In operation when a wave is encountered mechanical force pushes up on the front end of the hull which transfers the load along the hull thru the hull subframe and onto the vertical stanchions as the hull lifts vertically while it raises horizontal. This in turn lifts up and the inboard (furthest back points) ends of the swingarms which raises vertically while the outboard ends of the swingarms remain where they are and compresses the shock. Since the swingarms move downward the top section of the unit remains parallel to the hull but the distance between the hull and the top section shortens. The reverse allows the hull to take the movement of the water and the rider has a suspensions system between himself and the hull.

At the front of the waterbike, it can be seen that a front ski 10 is operationally connected to a set of handlebars 41 by a front shock absorber clamp means 70 which is connected and rotates within the top end of a pair of steering column supports 42 on the front of the body 4. In a similar fashion to the extension of the central lift shock tube 12 a pressurized gas is manually admitted into front shock absorber means 11 to raise the front of the waterbike 2.

The bottom portion of the front fork 46 is attached to a cup member 44 which has two parallel support arms 48 extending out and connected to the upper portion of the small shock absorber 50. The other lower portion of the small shock absorber 50 is also connected to the lower portion of the ski 10. When the front portion of the ski 10 is raised up, then it compresses the small shock absorber upward and into the parallel support arms 48 while pivoting on pivot axle 52 which can best be shown in FIG. 2.

The lower end of the shock 50 pivotally connects to the lower portion of the ski 10 in a similar fashion to allow the upward tilting of the ski 10 to accommodate turning against wave pressure. There is a trailing set of rear forks 62 extending from the rear of the cup 44 that connect pivotally to an extendable anti torque link 56 which keeps the ski 10 from turning because the bottom portion of the front shock 46 is rotatably housed in the middle portion of the front shock absorber means 60. The top end of the anti torque link 56 is fixedly attached to the middle shock absorber means 60. This prevents rotation of the ski 10 when encountering water forces or turbulence that would otherwise turn the ski 10 from side to side. The upper end of the front shock absorber means 11 is rotatably attached by a solid steering/support shaft 70 extending from its top to the front pillow bloc assembly 42 (like a steering post housing). The pillow block assembly 42 has a trailing front frame that connects to the body section 4. Body section 4 has a steering handlebar system 41 which connects by a tierod to a dog ear extending from the side of the steering/support shaft 70 as is well known in the art.

Generally, as the handlebars 41 are turned the ski 10 would turn also but the front tip of the ski would dive into the water and flip the waterbike 2. Instead the front tip of the ski is tilted upward like the elevator of a "Canard Wing Design" on an airplane now causing the front ski to turn in the direction it is pointing in as this is done the ski 10 turns and thus increases its drag on the waterbike 2. As the rear flow nozzle 44 pivots in the same direction as the front ski, it will push the rear of the watercraft in the opposite direction than the front ski is moving in. This creates more of a load to be put on it enabling it to turn the unit faster as the ski with its increased drag acts as a pivot point for the waterbike 2.

The central lift shock tube 12 and the front shock absorber means 11 besides raising the body section 6, fore and aft, act as pneumatic shock absorbers to somewhat dampen the pitch of the waterbike 2 as waves pass along the longitudinal axis of the waterbike 2. Additionally it serves to stabilize the front section of the lower hull 6 with respect to any movement of the body section 4.

The advantage of raising the waterbike's body section 4 above its lower hull section 6 is to allow a suspension system capable of handling the pitch, and a stabilization system capable of handling the tilt of the waterbike 2 to be placed between them, to reduce the drag of and minimize the contact hull surfaces of the waterbike, and to reduce the gas consumption and increase the top speed and acceleration.

Figure 6:
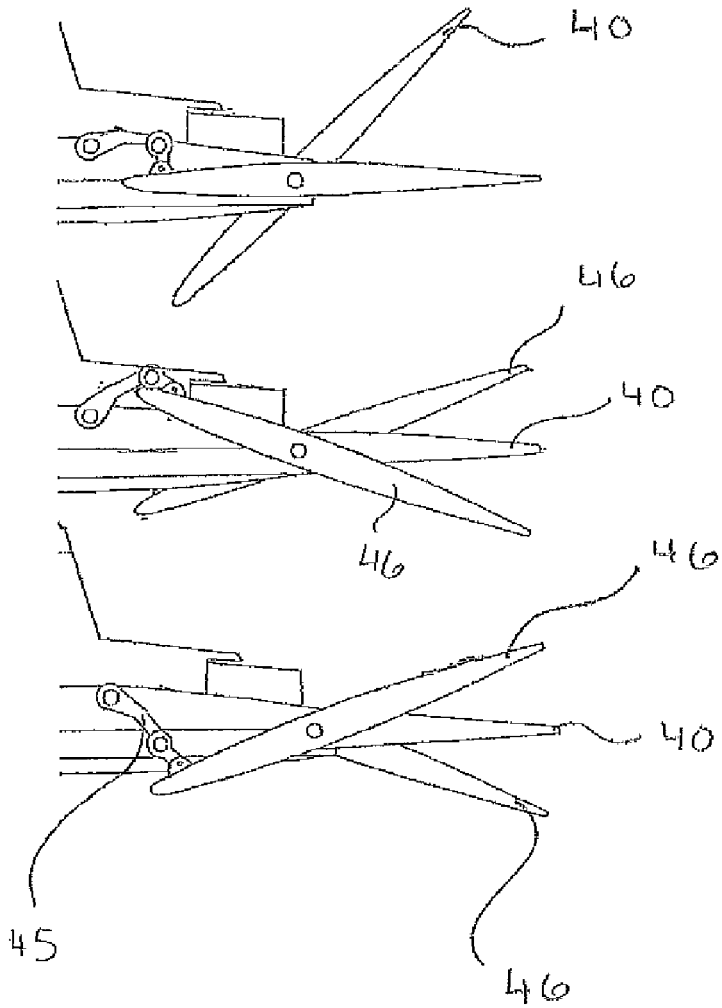
FIG. 6 is a series of three figures showing a conventional setup for the elevator lowered and the elevons in turning configurations.

The waterbike 2 also has a braking system and a stabilizing system that may work independently or in unison with the steering system which will be discussed in more detail herein. These three systems commonly share a set of three flaps positioned by a manual or automatic pneumatic, hydraulic or electric control system best seen on a typical setup as shown in FIG. 6 (two elevons 46 and one elevator 40). Such control systems are well known in the aviation and nautical fields and typically utilize a bell crank arm 45 that is extended by a pneumatic, hydraulic or electric actuator to adjust the vertical position of the attached flap.

Looking at FIG. 6 it can best be seen that at the rear of the waterbike 2 there are three flaps that are used to control the braking, steering and stabilization functions. These are all mounted and pivot about a common rear axle 74 oriented perpendicular to the longitudinal axis of the waterbike 2. The two elevons 46 and the elevator 40 are mounted on the axle 74 just slightly ahead of their axial center. Thus it will always take force to tilt any of the flaps' leading edges into the water. To tilt any flap further into the water will take increasing force since the surface area of each flap from its leading edge to the axis of tilt is less than the surface area from the axis of tilt to the trailing edge. As the moving water passes over the tilting flap more force acts upon the rear of the flap to try to keep the flap horizontal (or return it to a neutral position.) In this manner when under power, a rogue wave cannot grab the leading edge of any flap and pivot its position normal to the plane of forward motion of the waterbike 2, bringing it to an unexpected, abrupt stop.

The three flaps are controlled by three devices, the handlebars 41 (for steering), the computerized gyroscope (for stability), and the brake pedal (for braking and enhanced turning.) Each of these three devices sends a signal to a hydraulic flap manipulation system. Physical movement (positioning) of the three flaps is by hydraulic manipulation although electric servo motor manipulation has been successfully tested and is an acceptable substitute that does not depart form the scope of the invention. Such positioning systems have been utilized in the mechanical field of aviation for years and the details of their operation and the specific configuration and selection of their integral components do not comprise part of the present invention. For visual clarity the hydraulic flap manipulation system has been eliminated from the figures although the bell crank arm 45 that is extended by a pneumatic, hydraulic or electric actuator to adjust the vertical position of the attached flap can be seen in FIG. 6. The top illustration of FIG. 6 shows the centrally located elevator 40 in a "full stop" or down position. The middle illustration shows the elevons in a right turn position, and the bottom illustration shows the elevons in a left turn position.

When under power, the handlebars 41 of the waterbike 2 turn the front ski 10 and enable the turning of the jet nozzle 44 at the rear of the waterbike 2 which redirects the thrust of the water pushed past the propeller/impeller to steer the waterbike 2. Simultaneously, the elevons 46 both pivot (although in opposite fashion) and the elevator 40 dips slightly to frictionally engage the water surface and enhance the steering at power. The amount of movement of the elevons 46 and elevator 40 is proportional to the amount of handlebar movement.

When the engine is shut off but the waterbike 2 is still moving forward, there is no thrust from the jet nozzle 44 and without the flaps there would be a loss of steering. However, in the present invention the action of the elevons 46 and the elevator 40 in response to the handlebar 41 or brake pedal movement serve to continue the steering and braking functions, either independently or in unison.

The brake pedal controls only the position of the elevator 40. Depressing the brake pedal drives the leading edge of the elevator 40 further into the water regardless of what flap manipulations the handlebars 41 or the gyroscope are performing. The handlebars 41 counter pivot the two elevons 46 and slightly tilts the leading edge of the elevator 40. The computerized gyroscope rapidly counter pivots the two elevons 46 in relation to the roll (rotation of the waterbike 2 about its longitudinal axis) while the handlebars 41 remain within a specified number of degrees left or right of its neutral steering position. When a turn is being negotiated the handlebars 41 exceed this position and the gyroscope signal input to the hydraulic flap manipulation system is overridden.

The increased waterbike height enhances the motion experienced by the passengers as they are further from the axis of the roll, pitch and yaw of the passenger compartment as waves pass under the waterbike 2. Under power though, the waterbike's predominant motion is roll. Hence, the need for a stabilization system to minimize the side to side rocking. This is accomplished by a computerized gyroscopic control unit located on or adjacent a lower surface of the body section 4 that accomplishes a fast response to minimally tilt down the leading edge of the elevon 46 on the opposite side the waterbike 2 is rocking towards and to simultaneously minimally tilt the trailing edge of the elevon 46 on the side of the waterbike 2 is rocking toward. These elevon actions will compensate for the roll of the waterbike 2 when moving under power by counteracting the side to side forces. Essentially, the stabilization system's gyroscope continually adjusts the flaps when the waterbike 2 is under power and traveling in a straight line or under minimal steering (left or right movement of the handlebars) so as to maintain a level position for the body section 4 or when in a stable turn, BUT when making a sharp turn (once the handlebars 41 are moved beyond a certain position) the handlebar position overrides any gyroscope control signal.

It is to be noted that in a waterbike 2, because of the physical dynamics of its design, there is no need for the computerized gyroscope to control the yaw (side to side tilting about its longitudinal axis) and pitch (front to back tilting about its longitudinal axis.) As such, an acceptable substitute for the computerized gyroscope would be a simple computerized tilt meter that only sends out a signal to the hydraulic flap manipulation system based on the roll component of the waterbike 2. Computerized gyroscopic systems for the positioning of moveable means by hydraulic, pneumatic or electric actuators, have been utilized in numerous mechanical fields of endeavor for years and the details of their operation and the specific configuration and selection of their integral components do not comprise part of the present invention. For visual clarity the gyroscope and or tilt meter has been eliminated from the figures.

The movement of the various elements as described above is best illustrated in FIG. 6 with reference to the following chart.

Positions of Steering Stabilization System Elements with Applied Function (describes the position WRT the leading edges)

| | Elevon Position | | Elevator |
|---|---|---|---|
| Applied Function | R Elevon | L Elevon | Position |
| braking (with foot pedal) | up | up | down |
| turn right (w handlebars) | down | up | min down |
| turn left (w handlebars) | up | down | min down |
| simultaneous braking & turning | see above direction | see above direction | down |
| stabilizing function (gyroscope tilt controls as PWC rolls to left) | down | up | no movement |
| stabilizing function (gyroscope tilt controls as PWC rolls to right) | up | down | no movement |

The ability to make the waterbike 2 perform a trick maneuver is enhanced since the operator can now control the braking, the altitude of the unit and intensity of the turn.

Looking at FIG. 5 it can be seen that the body 4 is a graphite carbon fiber shell 77 formed into a tunnel housing with all of the electronics, steering and braking controls as well as the seats and gas tank. It is slidingly fitted over a subframe 20 that has two rubber lined dados that travers the linear axis of the body. These dados are matingingly conformed to two engagement slots that run along the linear axis of this tunnel housing and mechanical fasteners with the appropriate shock dampening grommets are used to connect the pieces.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. An improved personal watercraft subject to roll, pitch and yaw motion when undergoing motorized watersports wherein the improvement comprises:

an upper body section housing a watercraft's operational controls and passenger seating;

a lower hull section housing a propulsion system;

a front ski hull; and a suspension system connecting and disposed between said upper body section and said lower hull section and between said upper body and said front ski hull, said suspension system having a pressure actuation system, at least one tubular rear shock absorber having a distal end and a proximate end, said distal end of said rear shock absorber connected to a lower subframe affixed to said lower hull section and said proximate end of said rear shock absorber connected to a pivot linkage mechanism affixed to an upper subframe affixed to said body section, said pivot linkage mechanism pivotally connected to said proximate end of said shock absorber and pivotally connected to at least one lift arm which is pivotally connected to at least one rear stanchion mounted onto said lower hull section, and a tubular front shock absorber having a distal end and a proximate end, said distal end of said front shock absorber attached to said front ski hull and said proximate end of said front shock absorber connected to the front of said upper body section, and wherein said pressure actuation system has a compressor, a tank, a pressure gauge, and an actuator that is in operational connection with all of said shock absorbers so as to increase or decrease the distance between said distal ends and proximate ends by the addition of pressurized gas into said shock absorbers thereby adjusting the distance between said upper body section and each of the said front ski hull and said lower hull section and vertically raising said upper body from said lower hull section and said front ski hull, so as to reduce the roll, pitch and yaw motion.

2. The improved personal watercraft of claim 1 wherein said number of swingarms is two held in a parallel configuration on opposing sides of said proximate end of said shock absorber by a first axle, said number of liftarms is four arranged in two pairs of parallel configurations attached to said swingarms by a second and a third axle and wherein said number of rear stanchions is two which are attached to said swingarms by a fourth and a fifth axle.

3. The improved personal watercraft of claim 2 wherein said pressure actuation system is a pneumatic system.

4. The improved personal watercraft of claim 2 wherein said pressure actuation system is a hydraulic system.

5. The improved personal watercraft of claim 2 further comprising:

an integrated braking and steering system of three flaps each having a leading edge and a trailing edge a pivot axle passing axially through all three flaps at a location forward of each flap's axial midline;

a braking control system, wherein said flaps are pivotally mounted at a rear section of said lower hull section, having a central elevator flap flanked by an elevon flap on either side.

6. The improved personal watercraft of claim 5 wherein said braking control system comprises a bell crank arm that is extended or retracted by an actuator to pivotally maneuver said leading edge of each of said three flaps vertically with respect to the horizontal axis of the watercraft to steer or brake said watercraft.

7. The improved personal watercraft of claim 6 further comprising:

a two directional level sensing control operationally connected to said second actuation system to automatically operate said elevons in opposite directions to stabilize said watercraft in response to a roll motion experienced by said watercraft.

8. The improved personal watercraft of claim 7 wherein said braking control system is pneumatic.

9. The improved personal watercraft of claim 7 wherein said braking control system is hydraulic.

10. The improved personal watercraft of claim 7 wherein said braking control system comprises a set of electric servo motors.

11. The improved personal watercraft of claim 8 further comprising:

a foot actuated brake pedal; and a set of handlebars, wherein said brake pedal is operationally connected to cause said elevator leading edge to move vertically without any corresponding movement of said elevon flap to brake said watercraft, and wherein said set of handlebars are operationally connected to turn said front ski hull and to cause said elevon leading edges to move in opposite vertical directions simultaneously and cause said elevator leading edge to move vertically downward to steer said watercraft.

* * * * *